US009817327B2

(12) United States Patent
Takahashi et al.

(10) Patent No.: US 9,817,327 B2
(45) Date of Patent: Nov. 14, 2017

(54) TONER

(71) Applicant: CANON KABUSHIKI KAISHA, Tokyo (JP)

(72) Inventors: Toru Takahashi, Toride (JP); Daisuke Tsujimoto, Matsudo (JP); Yoshihiro Ogawa, Toride (JP); Hiroki Watanabe, Kashiwa (JP); Wakashi Iida, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/279,962

(22) Filed: Sep. 29, 2016

(65) Prior Publication Data

US 2017/0090323 A1 Mar. 30, 2017

(30) Foreign Application Priority Data

Sep. 30, 2015 (JP) ..... 2015-193275
May 11, 2016 (JP) ..... 2016-095152

(51) Int. Cl.
*G03G 9/097* (2006.01)
*G03G 9/087* (2006.01)
*G03G 9/09* (2006.01)

(52) U.S. Cl.
CPC ..... *G03G 9/09733* (2013.01); *G03G 9/08711* (2013.01); *G03G 9/08755* (2013.01); *G03G 9/0918* (2013.01)

(58) Field of Classification Search
CPC ..... G03G 9/09758
See application file for complete search history.

(56) References Cited

U.S. PATENT DOCUMENTS 5,365,256 A 11/1994 Takahashi
5,385,799 A * 1/1995 Ono ..... G03G 9/09758 430/108.2
5,949,449 A 9/1999 Takahashi
6,447,085 B1 9/2002 Yagi et al.
7,158,243 B2 1/2007 Sakamoto et al.

FOREIGN PATENT DOCUMENTS

| | | |
|---|---|---|
| JP | S57-014852 | 1/1982 |
| JP | S58-037653 | 3/1983 |
| JP | S58-097056 | 6/1983 |
| JP | S60-247250 | 12/1985 |
| JP | H04-362953 | 12/1992 |
| JP | H06-230600 | 8/1994 |
| JP | H08-030036 | 2/1996 |
| JP | H09-022147 | 1/1997 |
| JP | 2001-013714 | 1/2001 |
| JP | 2008-165005 | 7/2008 |
| JP | 2015-175858 | 10/2015 |

* cited by examiner

*Primary Examiner* — Hoa V Le
(74) *Attorney, Agent, or Firm* — Fitzpatrick Cella Harper and Scinto

(57) ABSTRACT

A toner comprises a binder resin, a colorant, and a compound represented by the following general formula [1]:

[1]

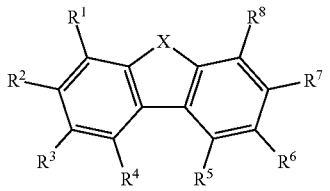

(in the formula, $R^1$ to $R^8$ each independently represent a group selected from the hydrogen atom, fluorine atom, bromine atom, iodine atom, hydroxy group, acetyl group, aldehyde group, $C_1$ to $C_6$ hydrocarbon groups, and amino group; X represents a group selected from the oxygen atom, sulfur atom, carbonyl group, and —$CR^9R^{10}$—; and $R^9$ and $R^{10}$ each independently represent a group selected from the hydrogen atom, bromine atom, $C_1$ to $C_3$ hydroxyalkyl groups, hydroxy group, phenyl group, and $C_1$ to $C_6$ hydrocarbon groups).

4 Claims, No Drawings

TONER

BACKGROUND OF THE INVENTION

Field of the Invention

The present invention relates to a toner used in electrophotography, in image-forming methods for visualizing electrostatic images, and in toner jets.

Description of the Related Art

Toner that can support a higher speed, higher image quality, longer life, and better energy conservation than in the past has come to be required in recent years in association with the development of image-forming apparatuses such as copiers and printers. Lowering the fixation temperature of a toner is effective for achieving energy conservation in, for example, a copier or printer, and toner that melts at lower temperatures is thus required. In addition, the use environment for toners has been undergoing diversification, and toner is thus required that can deliver a stable image even when used in a variety of environments.

Adjusting the melt viscosity of the binder resin—which is the major component of a toner—downward is known as a method for causing a toner to melt at a lower temperature. However, the durability of a toner is reduced when the melt viscosity of the binder resin itself is adjusted downward. As a result, after long-term use in a high-temperature, high-humidity environment, the amount of charge can undergo large fluctuations due to toner deterioration and density non-uniformity in halftone images (referred to as halftone non-uniformity in the following) may be produced. Various investigations have therefore been carried out into methods that do not lower the melt viscosity of the binder resin itself, but rather cause the toner to melt at a lower temperature through the addition of a plasticizer.

Japanese Patent Application Laid-open No. 2001-13714 proposes a method of controlling the melting characteristics of a toner through the use of a low melting point wax.

Japanese Patent Application Laid-open No. 2015-175858 proposes a toner that can cope with a broad fixation temperature region due to the incorporation in the toner of at least 6 mass % and not more than 17 mass % of bisphenoxyethanolfluorene.

Japanese Patent Application Laid-open No. 2008-165005, on the other hand, discloses a binder resin that uses bisphenoxyethanolfluorene as one of the monomers constituting the binder resin used in toner.

SUMMARY OF THE INVENTION

As indicated above, approaches for lowering the fixation temperature of toner have been investigated by carrying out investigations into additives. However, when the toner described in Japanese Patent Application Laid-open No. 2001-13714 is used, the low melting point wax is present as domains in the toner and due to this non-uniformity in the microdispersion is readily produced. As a result, after long-term use in a high-temperature, high-humidity environment, the amount of charging is reduced and the production of halftone non-uniformity is enhanced. Moreover, during long-term use, a portion of the wax domains present in the vicinity of the toner surface can transfer little by little to the fixing member and the fixing member can thereby be contaminated.

When the toner described in Japanese Patent Application Laid-open No. 2015-175858 is used, effects are obtained in terms of the fixing performance; however, when used in a high-temperature, high-humidity environment, the amount of charging can decline and the production of halftone non-uniformity can be enhanced.

In the case of the toner described in Japanese Patent Application Laid-open No. 2008-165005, bisphenoxyethanolfluorene is used as a monomer as a substitute for the bisphenol A derivatives heretofore used in binder resins. While the same compound as in Japanese Patent Application Laid-open No. 2015-175858 is used, it is not present in the toner as an additive and due to this effects are not obtained with regard to improving the low-temperature fixability or the charging performance.

The present invention was pursued in order to solve the problems identified above, and an object of the present invention is to provide a toner that has a better low-temperature fixability than heretofore, that resists contamination of the fixing member, and that resists the production of halftone non-uniformity even after long-term use in a high-temperature, high-humidity environment.

As a result of intensive investigations, the present inventors discovered that, by incorporating a binder resin, a colorant, and the compound represented by general formula [1] below into a toner, a toner can be provided that has a better low-temperature fixability than heretofore, that resists contamination of the fixing member, and that resists the production of halftone non-uniformity even after long-term use in a high-temperature, high-humidity environment.

[1]

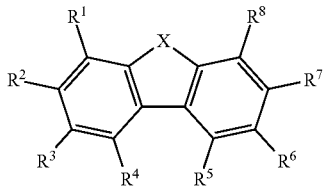

(In the formula, $R^1$ to $R^8$ each independently represent a group selected from the hydrogen atom, fluorine atom, bromine atom, iodine atom, hydroxy group, acetyl group, aldehyde group, $C_1$ to $C_6$ hydrocarbon groups, and amino group; X represents a group selected from the oxygen atom, sulfur atom, carbonyl group, and —$CR^9R^{10}$—; and $R^9$ and $R^{10}$ each independently represent a group selected from the hydrogen atom, bromine atom, $C_1$ to $C_3$ hydroxyalkyl groups, hydroxy group, phenyl group, and $C_1$ to $C_6$ hydrocarbon groups.)

In accordance with the present invention, a toner is obtained that has a better low-temperature fixability than heretofore, that resists contamination of the fixing member, and that resists the production of halftone non-uniformity even after long-term use in a high-temperature, high-humidity environment.

Further features of the present invention will become apparent from the following description of exemplary embodiments.

DESCRIPTION OF THE EMBODIMENTS

Unless specifically indicated otherwise, the phrases at least XX and not more than YY" and "XX to YY" that specify numerical value ranges indicate in the present invention numerical value ranges that include the lower limit and upper limit given as end points.

The present invention is described in detail in the following.

The present invention relates to a toner that characteristically contains a binder resin, a colorant, and a compound represented by general formula [1].

The present inventors discovered through their investigations that the use of such a toner can provide a toner that has a better low-temperature fixability than heretofore, that resists contamination of the fixing member, and that resists the production of halftone non-uniformity even after long-term use in a high-temperature, high-humidity environment.

The reasons that these excellent and not-heretofore-seen effects are obtained due to this constitution are thought to be as follows.

As a result of intensive investigations, the present inventors discovered that the compound represented by general formula [1] exhibits a very high compatibility with the binder resins that are generally used in toners (for example, vinyl resins, polyester resins, polyurethane resins, and so forth). Due to its uniform compatibilization with the binder resin used in the toner, the compound represented by general formula [1] does not segregate in the toner and is not released from the toner. Thus, toner containing the compound represented by general formula [1] will not contaminate the fixing member and, because it also enables the distribution in the amount of charge to be kept sharp, it suppresses the occurrence of halftone non-uniformity.

The present inventors also discovered that the compound represented by general formula [1] has a very high plasticizing effect for the binder resins used in toner (for example, vinyl resins, polyester resins, polyurethane resins, and so forth). Due to this, the compound represented by general formula [1] can effectively lower the melt viscosity of the toner and makes it possible to achieve a better low-temperature fixability than heretofore. The effects discussed above are thought to originate in the structure of the compound represented by general formula [1].

Based on the preceding, the use of a toner containing the compound represented by general formula [1] can provide a toner that has a better low-temperature fixability than heretofore, that resists contamination of the fixing member, and that resists the production of halftone non-uniformity even after long-term use in a high-temperature, high-humidity environment.

The compound represented by general formula [1] will now be described.

A characteristic feature of the present invention is that a compound with the following general formula [1] is incorporated in the toner.

[1]

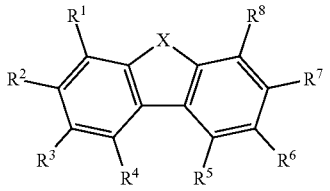

(In the formula, $R^1$ to $R^8$ each independently represent a group selected from the hydrogen atom, fluorine atom, bromine atom, iodine atom, hydroxy group, acetyl group, aldehyde group, $C_1$ to $C_6$ hydrocarbon groups (preferably at least 1 and not more than 4 carbons), and amino group; X represents a group selected from the oxygen atom, sulfur atom, carbonyl group, and —$CR^9R^{10}$—; and $R^9$ and $R^{10}$ each independently represent a group selected from the hydrogen atom, bromine atom, $C_1$ to $C_3$ hydroxyalkyl groups, hydroxy group, phenyl group, and $C_1$ to $C_6$ hydrocarbon groups.)

The $C_1$ to $C_6$ hydrocarbon group is more preferably the tertiary-butyl group. The $C_1$ to $C_3$ hydroxyalkyl group is preferably the methylol group.

When the X in general formula [1] is —$CR^9R^{10}$—, this indicates a compound represented by the following general formula [2].

[2]

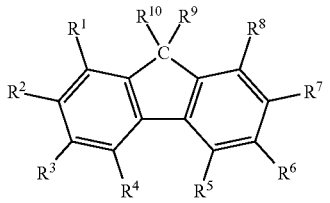

(In the formula, $R^1$ to $R^8$ each independently represent a group selected from the hydrogen atom, fluorine atom, bromine atom, iodine atom, hydroxy group, acetyl group, aldehyde group, $C_1$ to $C_6$ hydrocarbon groups (preferably at least 1 and not more than 4 carbons), and amino group, and $R^9$ and $R^{10}$ each independently represent a group selected from the hydrogen atom, bromine atom, $C_1$ to $C_3$ hydroxyalkyl groups, hydroxy group, phenyl group, and $C_1$ to $C_6$ hydrocarbon groups.)

The $C_1$ to $C_6$ hydrocarbon group is more preferably the tertiary-butyl group. The $C_1$ to $C_3$ hydroxyalkyl group is preferably the methylol group.

The compound represented by general formula [1] can be exemplified by the following:

fluorene and fluorene derivatives such as 9,9-dimethylfluorene, 2-amino-9,9-dimethylfluorene, 2-iodo-9,9-dimethylfluorene, 2-bromo-9,9-dimethylfluorene, 2-aminofluorene, 9-bromofluorene, 2-bromofluorene, 2,7-dibromo-9,9-dihexylfluorene, 2-iodofluorene, 2-fluorofluorene, 2-fluorenecarboxaldehyde, 9-fluorenol, 9-phenyl-9-fluorenol, 2-acetylfluorene, 2,7-di-tert-butylfluorene, and 9-fluorenylmethanol; fluorenone derivatives such as 9-fluorenone, 2-bromo-9-fluorenone, and 2-amino-9-fluorenone; dibenzothiophene and dibenzothiophene derivatives such as 2-bromodibenzothiophene, 4-bromodibenzothiophene, 4-iododibenzothiophene, dibenzothiophene-4-carboxaldehyde, and 2,8-dimethyldibenzothiophene; and dibenzofuran and dibenzofuran derivatives such as 2-bromodibenzofuran, 4-bromodibenzofuran, and dibenzofuran-2-carboxaldehyde.

Among the preceding, fluorene derivatives and fluorenone derivatives are more preferred, and fluorenone derivatives in which the X in general formula [1] is the carbonyl group are still more preferred.

The use of a fluorenone derivative in which X is the carbonyl group provides an even better plasticizing effect for the toner and thus yields an excellent low-temperature fixability.

The content of the compound represented by general formula [1], expressed per 100 mass parts of the binder resin, is preferably at least 0.1 mass parts and not more than 20 mass parts, more preferably at least 0.2 mass parts and not more than 10 mass parts, and even more preferably at least 1 mass part and not more than 5 mass parts. By controlling the content of the compound represented by general formula [1] into the indicated range, an even better plasticizing effect for the toner and an even better compatibility are obtained; an excellent low-temperature fixability and an excellent contamination behavior relative to the fixing member are obtained; and an image presenting little halftone non-uniformity can be obtained even after long-term use in a high-temperature, high-humidity environment. The presence of the compound represented by formula [1] in a toner can be checked using, for example, a pyrolysis gas chromatograph/mass spectrometer or a nuclear magnetic resonance instrument ($^1$H-NMR).

The compound represented by general formula [1] has a melting point of preferably at least 55° C. and not more than 180° C., more preferably at least 65° C. and not more than 160° C., and even more preferably at least 70° C. and not more than 100° C. By having the melting point of the compound represented by general formula [1] be in the indicated range, handling during toner production is facilitated and a uniform compatibilization with the binder resin in the toner can be brought about. As a result, the compatibility and plasticizing effect for the toner are more favorably preserved and due to this an excellent low-temperature fixability can be obtained and an image presenting little halftone non-uniformity can be obtained.

The compound represented by general formula [1] preferably has a boiling point of at least 290° C. By having the boiling point be at least 290° C., volatilization of the compound can be inhibited even during the heating during fixing and contamination of the fixing member can then be suppressed. The upper limit, while not being particularly limited, is preferably not more than 600° C. and is more preferably not more than 500° C.

The binder resin used in the toner of the present invention is exemplified by the following: styrene resins, styrene copolymer resins, polyester resins, polyol resins, polyvinyl chloride resins, phenolic resins, natural modified phenolic resins, natural resin-modified maleic acid resins, acrylic resins, methacrylic resins, polyvinyl acetates, silicone resins, polyurethane resins, polyamide resins, furan resins, epoxy resins, xylene resins, polyvinyl butyrals, terpene resins, coumarone-indene resins, and petroleum resins. The following are resins preferred for use among the preceding: styrene copolymer resins, polyester resins, and hybrid resins provided by mixing a polyester resin with a styrene copolymer resin or partially reacting the two.

The components constituting the polyester resin will be described. One or two or more of the various components described in the following can be used in conformity with the type and application.

The dibasic acid component constituting the polyester resin can be exemplified by the following dicarboxylic acids and derivatives thereof: benzenedicarboxylic acids such as phthalic acid, terephthalic acid, isophthalic acid, and phthalic anhydride, and their anhydrides and lower alkyl esters; alkyldicarboxylic acids such as succinic acid, adipic acid, sebacic acid, and azelaic acid, and their anhydrides and lower alkyl esters; alkenylsuccinic acids and alkylsuccinic acids having an average value for the number of carbons of at least 1 and not more than 50, and their anhydrides and lower alkyl esters; and unsaturated dicarboxylic acids such as fumaric acid, maleic acid, citraconic acid, and itaconic acid, and their anhydrides and lower alkyl esters.

The dihydric alcohol component constituting the polyester resin, on the other hand, can be exemplified by the following: ethylene glycol, polyethylene glycol, 1,2-propanediol, 1,3-propanediol, 1,3-butanediol, 1,4-butanediol, 2,3-butanediol, diethylene glycol, triethylene glycol, 1,5-pentanediol, 1,6-hexanediol, neopentyl glycol, 2-methyl-1,3-propanediol, 2-ethyl-1,3-hexanediol, 1,4-cyclohexanedimethanol (CHDM), hydrogenated bisphenol A, bisphenols represented by formula (I-1) and their derivatives, and diols represented by formula (I-2).

(I-1)

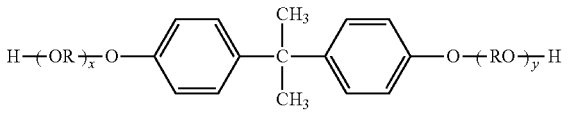

(In the formula, R is an ethylene or propylene group; x and y are each integers equal to or greater than 0; and the average value of x+y is at least 0 and not more than 10.)

(I-2)

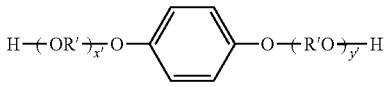

(In the formula, R' is an ethylene or propylene group; x' and y' are each integers equal to or greater than 0; and the average value of x'+y' is at least 0 and not more than 10.)

In addition to the dibasic carboxylic acid compound and dihydric alcohol compound described above, the constituent components of the polyester resin may include tribasic and higher basic carboxylic acid compounds and trihydric and higher hydric alcohol compounds as constituent components.

The tribasic and higher basic carboxylic acid compounds are not particularly limited and can be exemplified by trimellitic acid, trimellitic anhydride, and pyromellitic acid. In addition, the trihydric and higher hydric alcohol compounds can be exemplified by trimethylolpropane, pentaerythritol, and glycerol.

The method for producing the polyester resin is not particularly limited and known methods can be used. For example, the polyester resin can be produced by polymerizing the aforementioned dibasic carboxylic acid compound and dihydric alcohol compound via an esterification reaction or transesterification reaction and a condensation reaction. The polymerization temperature is not particularly limited, but the range of at least 180° C. and not more than 290° C. is preferred. A polymerization catalyst, for example, a titanium catalyst, tin catalyst, zinc acetate, antimony trioxide, germanium dioxide, and so forth, can be used during polymerization to give the polyester resin.

Preferably at least styrene is used as the vinyl monomer for producing the styrene copolymer resin. Styrene is more advantageous with regard to the durability stability due to the large proportion taken up by the aromatic ring in its molecular structure. The content of the styrene in the vinyl monomer is preferably at least 70 mass % and more preferably at least 85 mass %. While the upper limit is not particularly limited, it is generally equal to or less than 100 mass %.

Styrene monomers and acrylic acid monomers as follows are examples of the vinyl monomer other than styrene for forming the styrene copolymer resin.

The styrene monomer can be exemplified by styrene derivatives such as o-methylstyrene, m-methylstyrene, p-methylstyrene, p-phenylstyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, p-chlorostyrene, 3,4-dichlorostyrene, m-nitrostyrene, o-nitrostyrene, and p-nitrostyrene.

The acrylic acid monomer can be exemplified by acrylic acid and acrylate esters such as acrylic acid, methyl acrylate, ethyl acrylate, propyl acrylate, n-butyl acrylate, isobutyl acrylate, n-octyl acrylate, dodecyl acrylate, 2-ethylhexyl acrylate, stearyl acrylate, 2-chloroethyl acrylate, and phenyl acrylate; α-methylene aliphatic monocarboxylic acids and their esters such as methacrylic acid, methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; as well as by derivatives of acrylic acid or methacrylic acid such as acrylonitrile, methacrylonitrile, and acrylamide.

The monomer constituting the styrene copolymer resin can also be exemplified by hydroxy group-bearing monomers such as acrylate and methacrylate esters such as 2-hydroxyethyl acrylate, 2-hydroxyethyl methacrylate, and 2-hydroxypropyl methacrylate, as well as 4-(1-hydroxy-1-methylbutyl)styrene and 4-(1-hydroxy-1-methylhexyl)styrene.

Various monomers capable of undergoing vinyl polymerization may optionally be co-used in the styrene copolymer resin. These monomers can be exemplified by ethylenically unsaturated monoolefins such as ethylene, propylene, butylene, and isobutylene; unsaturated polyenes such as butadiene and isoprene; vinyl halides such as vinyl chloride, vinylidene chloride, vinyl bromide, and vinyl fluoride; vinyl esters such as vinyl acetate, vinyl propionate, and vinyl benzoate; vinyl ethers such as vinyl methyl ether, vinyl ethyl ether, and vinyl isobutyl ether; vinyl ketones such as vinyl methyl ketone, vinyl hexyl ketone, and methyl isopropenyl ketone; N-vinyl compounds such as N-vinylpyrrole, N-vinylcarbazole, N-vinylindole, and N-vinylpyrrolidone; vinylnaphthalenes; and also unsaturated dibasic acids such as maleic acid, citraconic acid, itaconic acid, alkenylsuccinic acid, fumaric acid, and mesaconic acid; unsaturated dibasic acid anhydrides such as maleic anhydride, citraconic anhydride, itaconic anhydride, and alkenylsuccinic anhydride; the half esters of unsaturated dibasic acids, such as monomethyl maleate, monoethyl maleate, monobutyl maleate, monomethyl citraconate, monoethyl citraconate, monobutyl citraconate, monomethyl itaconate, monomethyl alkenylsuccinate, monomethyl fumarate, and monomethyl mesaconate; unsaturated dibasic acid esters such as dimethyl maleate and dimethyl fumarate; the acid anhydrides of α,β-unsaturated acids such as acrylic acid, methacrylic acid, crotonic acid, and cinnamic acid; anhydrides between these α,β-unsaturated acids and lower fatty acids; and carboxyl group-bearing monomers such as alkenylmalonic acid, alkenylglutaric acid, and alkenyladipic acid and their acid anhydrides and monoesters.

The styrene copolymer resin may optionally be a polymer crosslinked by crosslinking monomers, such as those provided as examples in the following. The crosslinking monomer can be exemplified by aromatic divinyl compounds, alkyl chain-linked diacrylate compounds, diacrylate compounds in which linkage is effected by an alkyl chain that contains an ether linkage, diacrylate compounds in which linkage is effected by a chain that has an aromatic group and an ether linkage, polyester-type diacrylates, and polyfunctional crosslinking agents.

The aromatic divinyl compounds can be exemplified by divinylbenzene and divinylnaphthalene.

The alkyl chain-linked diacrylate compounds can be exemplified by ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, and compounds provided by replacing the acrylate in the preceding compounds with methacrylate.

The diacrylate compounds in which linkage is effected by an alkyl chain that contains an ether linkage can be exemplified by diethylene glycol diacrylate, triethylene glycol diacrylate, tetraethylene glycol diacrylate, polyethylene glycol #400 diacrylate, polyethylene glycol #600 diacrylate, dipropylene glycol diacrylate, and compounds provided by replacing the acrylate in the preceding compounds with methacrylate.

The diacrylate compounds in which linkage is effected by a chain that has an aromatic group and an ether linkage can be exemplified by polyoxyethylene(2)-2,2-bis(4-hydroxyphenyl)propane diacrylate, polyoxyethylene(4)-2,2-bis(4-hydroxyphenyl)propane diacrylate, and compounds provided by replacing the acrylate in the preceding compounds with methacrylate. An example of the polyester-type diacrylate compounds is the product named "MANDA" (Nippon Kayaku Co., Ltd.).

The polyfunctional crosslinking agents can be exemplified by pentaerythritol triacrylate, trimethylolethane triacrylate, trimethylolpropane triacrylate, tetramethylolmethane tetraacrylate, oligoester acrylate, and compounds provided by replacing the acrylate in the preceding compounds with methacrylate, and also by triallyl cyanurate and triallyl trimellitate.

The styrene copolymer resin may be a resin produced using a polymerization initiator. Viewed in terms of efficiency, the polymerization initiator is preferably used at at least 0.05 mass parts and not more than 10 mass parts per 100 mass parts of the monomer.

The polymerization initiator can be exemplified by 2,2'-azobisisobutyronitrile, 2,2'-azobis(4-methoxy-2,4-dimethylvaleronitrile), 2,2'-azobis(2,4-dimethylvaleronitrile), 2,2'-azobis(2-methylbutyronitrile), dimethyl 2,2'-azobisisobutyrate, 1,1'-azobis(1-cyclohexanecarbonitrile), 2-(carbamoylazo)isobutyronitrile, 2,2'-azobis(2,4,4-trimethylpentane), 2-phenylazo-2,4-dimethyl-4-methoxyvaleronitrile, 2,2'-azobis(2-methylpropane), ketone peroxides (e.g., methyl ethyl ketone peroxide, acetylacetone peroxide, cyclohexanone peroxide), 2,2-bis(t-butylperoxy)butane, t-butyl hydroperoxide, cumene hydroperoxide, 1,1,3,3-tetramethylbutyl hydroperoxide, di-t-butyl peroxide, t-butyl cumyl peroxide, dicumyl peroxide, α,α'-bis(t-butylperoxyisopropyl)benzene, isobutyl peroxide, octanoyl peroxide, decanoyl peroxide, lauroyl peroxide, 3,5,5-trimethylhexanoyl peroxide, benzoyl peroxide, m-toluoyl peroxide, diisopropyl peroxydicarbonate, di-2-ethylhexyl peroxydicarbonate, di-n-propyl peroxydicarbonate, di-2-ethoxyethyl peroxycarbonate, dimethoxyisopropyl peroxydicarbonate, di(3-methyl-3-methoxybutyl) peroxycarbonate, acetylcyclohexylsulfonyl peroxide, t-butyl peroxyacetate, t-butyl peroxyisobutyrate, t-butyl peroxyneodecanoate, t-butyl peroxy-2-ethylhexanoate, t-butyl peroxylaurate, t-butyl peroxybenzoate, t-butylperoxy isopropyl carbonate, di-t-butyl peroxyisophthalate, t-butylperoxy allyl carbonate, t-amyl peroxy-2-ethylhexanoate, di-t-butyl peroxyhexahydroterephthalate, and di-t-butyl peroxyazelate.

The hybrid resin referenced above is a resin provided by mixing a polyester resin with a styrene copolymer resin or by partially reacting the two.

For this purpose, polymerization is preferably carried out using a compound capable of reacting with monomer for both of the resins (referred to hereafter as a "bireactive compound"). Among the aforementioned monomers for the polyester resin and monomers for the styrene copolymer resin, such a bireactive compound can be exemplified by compounds such as fumaric acid, acrylic acid, methacrylic acid, citraconic acid, maleic acid, and dimethyl fumarate. Among these, the use is preferred of fumaric acid, acrylic acid, and methacrylic acid.

The hybrid resin can be obtained by a method in which the starting monomer for the polyester resin and the starting monomer for the styrene copolymer resin are reacted at the same time or sequentially. For example, molecular weight control is readily exercised when an addition polymerization reaction is run on the monomer for the styrene copolymer resin followed by carrying out a condensation polymerization reaction with the starting monomer for the polyester.

Viewed from the standpoint of control of the crosslinking structures at a molecular level, the mixing ratio (mass ratio) between the polyester resin and styrene copolymer resin in the hybrid resin is preferably 50/50 to 90/10 (polyester resin/styrene copolymer resin), while 50/50 to 80/20 is more preferred.

The binder resin may contain two or more binder resins.

When it contains two or more binder resins, the resin with high softening point preferably has a softening point of at least 120° C. and not more than 170° C. In addition, the resin with low softening point preferably has a softening point of at least 70° C. and less than 120° C.

The incorporation of two or more binder resins having different softening points is preferred because this makes it relatively easy to design the molecular weight distribution of the toner and to generate a broad fixing region.

When a single binder resin is used by itself, its softening point is preferably at least 95° C. and not more than 170° C. At least 120° C. and not more than 160° C. is more preferred. An excellent resistance to hot offset and an excellent low-temperature fixability are obtained when the softening point is in the indicated range.

The softening point is measured proceeding as follows. The softening point of the resin is measured using a "Flowtester CFT-500D Flow Property Evaluation Instrument", a constant-load extrusion-type capillary rheometer (Shimadzu Corporation), in accordance with the manual provided with the instrument. With this instrument, while a constant load is applied by a piston from the top of the measurement sample, the measurement sample filled in a cylinder is heated and melted and the melted measurement sample is extruded from a die at the bottom of the cylinder; a flow curve showing the relationship between piston stroke and temperature is obtained from this.

The "melting temperature by the ½ method", as described in the manual provided with the "Flowtester CFT-500D Flow Property Evaluation Instrument", is used as the softening point in the present invention. The melting temperature by the ½ method is determined as follows. First, ½ of the difference between Smax, which is the piston stroke at the completion of outflow, and Smin, which is the piston stroke at the start of outflow, is determined (this value is designated as X, where X=(Smax−Smin)/2). The temperature of the flow curve when the piston stroke in the flow curve reaches the sum of X and Smin is the melting temperature Tm by the ½ method.

The measurement sample is prepared by subjecting approximately 1.3 g of the sample to compression molding for approximately 60 seconds at approximately 10 MPa in a 25° C. atmosphere using a tablet compression molder (for example, the NT-100H from NPa System Co., Ltd.) to provide a cylindrical shape with a diameter of approximately 8 mm.

The measurement conditions with the CFT-500D are as follows.

test mode: rising temperature method
start temperature: 50° C.
saturated temperature: 200° C.
measurement interval: 1.0° C.
ramp rate: 4.0° C./min
piston cross section area: 1.000 $cm^2$
test load (piston load): 10.0 kgf (0.9807 MPa)
preheating time: 300 seconds
diameter of die orifice: 1.0 mm
die length: 1.0 mm The glass transition temperature (Tg) of the binder resin is preferably at least 45° C. from the standpoint of the storage stability. Viewed in terms of the low-temperature fixability, Tg is preferably not more than 75° C. and more preferably is not more than 70° C.

The glass transition temperature (Tg) of a toner binder resin is measured at normal temperature and normal humidity in accordance with ASTM D 3418-82 using a differential scanning calorimeter (DSC) or an MDSC-2920 (TA Instruments). Approximately 3 mg of the binder resin is precisely weighed out and used as the measurement sample. This is placed in an aluminum pan, and an empty aluminum pan is used as the reference. Using 30° C. to 200° C. for the measurement temperature range, heating is carried out from 30° C. to 200° C. at a ramp rate of 10° C./min followed by cooling from 200° C. to 30° C. at a ramp down rate of 10° C./min; reheating is then carried out to 200° C. at a ramp rate of 10° C./min. Using the DSC curve obtained in the second heating process, the glass transition temperature Tg of the resin is taken to be the point at the intersection between the differential heat curve and the line for the midpoint for the baselines for prior to and subsequent to the appearance of the change in the specific heat.

The toner of the present invention may be used as a magnetic one-component toner, a nonmagnetic one-component toner, or a nonmagnetic two-component toner.

When used as a magnetic one-component toner, magnetic iron oxide particles are preferably used as the colorant. The magnetic iron oxide particles present in the magnetic one-component toner can be exemplified by magnetic iron oxides such as magnetite, maghemite, and ferrite and by magnetic iron oxides that contain another metal oxide; and metals such as Fe, Co, and Ni, or alloys between these metals and metals such as Al, Co, Cu, Pb, Mg, Ni, Sn, Zn, Sb, Be, Bi, Cd, Ca, Mn, Se, Ti, W, and V, and mixtures of the preceding.

The magnetic iron oxide particle content is preferably at least 30 mass parts and not more than 150 mass parts per 100 mass parts of the binder resin.

The colorant in the case of use as a nonmagnetic one-component toner or nonmagnetic two-component toner can be exemplified as follows.

A carbon black, e.g., furnace black, channel black, acetylene black, thermal black, lamp black, and so forth, can be used as a black pigment; a magnetic powder such as magnetite or ferrite may also be used as a black pigment.

Pigments and dyes can be used as favorable yellow colorants. The pigments can be exemplified by C. I. Pigment Yellow 1, 2, 3, 4, 5, 6, 7, 10, 11, 12, 13, 14, 15, 17, 23, 62, 65, 73, 74, 81, 83, 93, 94, 95, 97, 98, 109, 110, 111, 117, 120, 127, 128, 129, 137, 138, 139, 147, 151, 154, 155, 167, 168, 173, 174, 176, 180, 181, 183, and 191, and by C. I. Vat Yellow 1, 3, and 20. The dyes can be exemplified by C. I. Solvent Yellow 19, 44, 77, 79, 81, 82, 93, 98, 103, 104, 112, and 162. A single one of these may be used or two or more may be used in combination.

Pigments and dyes can be used as favorable cyan colorants. The pigments can be exemplified by C. I. Pigment Blue 1, 7, 15, 15:1, 15:2, 15:3, 15:4, 16, 17, 60, 62, and 66 and by C. I. Vat Blue 6 and C. I. Acid Blue 45. The dyes can be exemplified by C. I. Solvent Blue 25, 36, 60, 70, 93, and 95. A single one of these may be used or two or more may be used in combination.

Pigments and dyes can be used as favorable magenta colorants. The pigments can be exemplified by C. I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 48:2, 48:3, 48:4, 49, 50, 51, 52, 53, 54, 55, 57, 57:1, 58, 60, 63, 64, 68, 81, 81:1, 83, 87, 88, 89, 90, 112, 114, 122, 123, 144, 146, 150, 163, 166, 169, 177, 184, 185, 202, 206, 207, 209, 220, 221, 238, and 254, and by C. I. Pigment Violet 19 and C. I. Vat Red 1, 2, 10, 13, 15, 23, 29, and 35. The magenta dyes can be exemplified by oil-soluble dyes such as C. I. Solvent Red 1, 3, 8, 23, 24, 25, 27, 30, 49, 52, 58, 63, 81, 82, 83, 84, 100, 109, 111, 121, and 122, C. I. Disperse Red 9, C. I. Solvent Violet 8, 13, 14, 21, and 27, and C. I. Disperse Violet 1, and by basic dyes such as C. I. Basic Red 1, 2, 9, 12, 13, 14, 15, 17, 18, 22, 23, 24, 27, 29, 32, 34, 35, 36, 37, 38, 39, and 40, and C. I. Basic Violet 1, 3, 7, 10, 14, 15, 21, 25, 26, 27, and 28. A single one of these may be used or two or more may be used in combination.

The colorant content is preferably at least 1 mass part and not more than 20 mass parts per 100 mass parts of the binder resin.

A release agent (wax) may be used in order to impart releasability to the toner. Viewed in terms of the ease of dispersion in the toner particle and the extent of the releasability, the use is preferred for this wax of an aliphatic hydrocarbon wax such as a low molecular weight polyethylene, low molecular weight polypropylene, Fischer-Tropsch wax, microcrystalline wax, or paraffin wax. As necessary, a single wax or two or more waxes may be co-used therewith in small amounts.

Hydrocarbons that are a source for aliphatic hydrocarbon waxes can be specifically exemplified by the following: hydrocarbon synthesized by the reaction of carbon monoxide and hydrogen using a metal oxide catalyst (frequently a multicomponent system that is a binary or higher system) (for example, hydrocarbon compounds synthesized by the Synthol method or Hydrocol method (use of a fluidized catalyst bed)); hydrocarbon having up to about several hundred carbons, obtained by the Arge method (use of a fixed catalyst bed), which produces large amounts of waxy hydrocarbon; and hydrocarbon provided by the polymerization of an alkylene, e.g., ethylene, using a Ziegler catalyst.

The following are examples at a more specific level: VISKOL® 330-P, 550-P, 660-P, and TS-200 (Sanyo Chemical Industries, Ltd.); Hi-WAX 400P, 200P, 100P, 410P, 420P, 320P, 220P, 210P, and 110P (Mitsui Chemicals, Inc.); Sasol H1, H2, C80, C105, and C77 (Sasol); HNP-1, HNP-3, HNP-9, HNP-10, HNP-11, and HNP-12 (Nippon Seiro Co., Ltd.); UNILIN® 350, 425, 550, and 700 and UNICID® 350, 425, 550, and 700 (Toyo Petrolite Co., Ltd.); and Japan Wax, Beeswax, Rice Wax, Candelilla Wax, and Carnauba Wax (Cerarica NODA Co., Ltd.).

The following can also be used as the release agent: oxides of aliphatic hydrocarbon waxes, such as oxidized polyethylene wax, and their block copolymers; waxes in which the major component is fatty acid ester, such as montanoic acid ester waxes; and waxes provided by the partial or complete deacidification of a fatty acid ester, e.g., deacidified carnauba wax. In addition, the following can be used as the release agent:

saturated straight-chain fatty acids such as palmitic acid, stearic acid, and montanoic acid; unsaturated fatty acids such as brassidic acid, eleostearic acid, and parinaric acid; saturated alcohols such as stearyl alcohol, aralkyl alcohols, behenyl alcohol, carnaubyl alcohol, ceryl alcohol, and melissyl alcohol; long-chain alkyl alcohols; polyhydric alcohols such as sorbitol; fatty acid amides such as linoleamide, oleamide, and lauramide; saturated fatty acid bisamides such as methylenebisstearamide, ethylenebiscapramide, ethylenebislauramide, and hexamethylenebisstearamide; unsaturated fatty acid amides such as ethylenebisoleamide, hexamethylenebisoleamide, N,N'-dioleyladipamide, and N,N-dioleylsebacamide; aromatic bisamides such as m-xylenebisstearamide and N,N-distearylisophthalamide; fatty acid metal salts (generally known as metal soaps) such as calcium stearate, calcium laurate, zinc stearate, and magnesium stearate; waxes provided by grafting an aliphatic hydrocarbon wax using a vinylic monomer such as styrene or acrylic acid; partial esters provided by the reaction of a polyhydric alcohol with a fatty acid, such as behenic monoglyceride; and hydroxyl group-containing methyl ester compounds obtained by the hydrogenation of plant oils.

With regard to the timing of release agent addition, it may be added during toner production or may be added during production of the binder resin. A single one of these release agents may be used by itself or two or more may be used in combination. The release agent is preferably added at at least 1 mass part and not more than 20 mass parts per 100 mass parts of the binder resin.

A known charge control agent can be used as a charge control agent in the toner. The known charge control agents can be exemplified by azo iron compounds, azo chromium compounds, azo manganese compounds, azo cobalt compounds, azo zirconium compounds, chromium compounds of carboxylic acid derivatives, zinc compounds of carboxylic acid derivatives, aluminum compounds of carboxylic acid derivatives, and zirconium compounds of carboxylic acid derivatives. Aromatic hydroxycarboxylic acids are preferred for the carboxylic acid derivatives. A charge control resin may also be used. As necessary, one or two or more charge control agents may be co-used therewith. The charge control agent is preferably added at at least 0.1 mass parts and not more than 10 mass parts per 100 mass parts of the binder resin.

The toner of the present invention may be mixed with a carrier and used as a two-component developer. An ordinary carrier such as ferrite or magnetite or a resin-coated carrier can be used as the carrier. Also usable are binder-type carrier cores in which a magnetic powder is dispersed in a resin.

A resin-coated carrier is composed of a carrier core particle and a coating material, this latter being a resin that covers (coats) the surface of the carrier core particle. The resin used for this coating material can be exemplified by styrene-acrylic resins such as styrene-acrylate ester copolymers and styrene-methacrylate ester copolymers; acrylic resins such as acrylate ester copolymers and methacrylate ester copolymers; fluorine-containing resins such as polytetrafluoroethylene, monochlorotrifluoroethylene polymers, and polyvinylidene fluoride; silicone resins; polyester resins; polyamide resins; polyvinyl butyrals; and aminoacrylate resins. Additional examples are ionomer resins and polyphenylene sulfide resins. A single one of these resins may be used or a plurality may be used in combination.

In order to improve the charge stability, developing performance, flowability, and durability, a silica fine powder is preferably externally added to the toner particle in the toner of the present invention. This silica fine powder has a specific surface area by the nitrogen adsorption-based BET method preferably of at least 30 $m^2/g$ and not more than 500 $m^2/g$ and more preferably at least 50 $m^2/g$ and not more than 400 $m^2/g$. The silica fine powder is used, expressed per 100 mass parts of the toner particles, preferably at at least 0.01 mass parts and not more than 8.00 mass parts and more preferably at least 0.10 mass parts and not more than 5.00 mass parts.

The BET specific surface area of the silica fine powder can be determined using a multipoint BET method by the adsorption of nitrogen gas to the surface of the silica fine powder using, for example, an Autosorb 1 (Yuasa Ionics Co., Ltd.), GEMINI 2360/2375 (Micromeritics Instrument Corporation), or TriStar-3000 (Micromeritics Instrument Corporation) specific surface area analyzer.

For the purpose of hydrophobing and controlling the triboelectric charging characteristics, the silica fine powder is optionally preferably also treated with a treatment agent, e.g., an unmodified silicone varnish, various modified silicone varnishes, an unmodified silicone oil, various modified silicone oils, a silane coupling agent, a functional group-bearing silane compound, or other organosilicon compounds, or with a combination of different treatment agents.

Other external additives may also be added to the toner of the present invention on an optional basis. These external additives can be exemplified by resin fine particles and inorganic fine powders that function as, for example, an auxiliary charging agent, an agent that imparts electroconductivity, a flowability-imparting agent, an anti-caking agent, a release agent for hot roller fixing, a lubricant, an abrasive, and so forth. The auxiliary charging agent can be exemplified by metal oxides such as titanium oxide, zinc oxide, and alumina. The lubricant can be exemplified by polyethylene fluoride powder, zinc stearate powder, and polyvinylidene fluoride powder. The abrasive can be exemplified by cerium oxide powder, silicon carbide powder, and strontium titanate powder. Strontium titanate powder is preferred among the preceding.

The toner particle production method can be exemplified by the pulverization method, emulsion aggregation method, suspension polymerization method, and dissolution suspension method.

Toner particle production by the pulverization method may proceed, for example, as follows. The binder resin, colorant, compound represented by general formula [1], and other optional additives and so forth are thoroughly mixed using a mixer such as a Henschel mixer or ball mill. The mixture is melt kneaded using a melt kneader such as a twin-screw kneading extruder, hot roll, kneader, or extruder. Wax, magnetic iron oxide particles, and metal-containing compounds can also be added at this time. After the melt-kneaded material has been cooled and solidified, it is pulverized and classified to yield toner particles. The toner can be obtained as necessary by mixing the toner particles with external additive using a mixer such as a Henschel mixer.

The mixer can be exemplified by the following: Henschel mixer (Mitsui Mining Co., Ltd.); Supermixer (Kawata Mfg Co., Ltd.); Ribocone (Okawara Mfg. Co., Ltd.); Nauta mixer, Turbulizer, and Cyclomix (Hosokawa Micron Corporation); Spiral Pin Mixer (Pacific Machinery & Engineering Co., Ltd.); and Loedige Mixer (Matsubo Corporation).

The kneader can be exemplified by the following: KRC Kneader (Kurimoto, Ltd.); Buss Ko-Kneader (Buss Corp.); TEM extruder (Toshiba Machine Co., Ltd.); TEX twin-screw kneader (The Japan Steel Works, Ltd.); PCM Kneader (Ikegai Ironworks Corp.); three-roll mills, mixing roll mills, and kneaders (Inoue Mfg., Inc.); Kneadex (Mitsui Mining Co., Ltd.); model MS pressure kneader and Kneader-Ruder (Moriyama Works); and Banbury mixer (Kobe Steel, Ltd.).

The pulverizer can be exemplified by the following: Counter Jet Mill, Micron Jet, and Inomizer (Hosokawa Micron Corporation); IDS mill and PJM Jet Mill (Nippon Pneumatic Mfg. Co., Ltd.); Cross Jet Mill (Kurimoto, Ltd.); Ulmax (Nisso Engineering Co., Ltd.); SK Jet-O-Mill (Seishin Enterprise Co., Ltd.); Kryptron (Kawasaki Heavy Industries, Ltd.); Turbo Mill (Turbo Kogyo Co., Ltd.); and Super Rotor (Nisshin Engineering Inc.).

The classifier can be exemplified by the following: Classiel, Micron Classifier, and Spedic Classifier (Seishin Enterprise Co., Ltd.); Turbo Classifier (Nisshin Engineering Inc.); Micron Separator, Turboplex (ATP), and TSP Separator (Hosokawa Micron Corporation); Elbow Jet (Nittetsu Mining Co., Ltd.); Dispersion Separator (Nippon Pneumatic Mfg. Co., Ltd.); and YM Microcut (Yaskawa & Co., Ltd.).

Screening devices that can be used to screen the coarse particles can be exemplified by the following: Ultrasonic (Koei-Sangyo Co., Ltd.), Rezona Sieve and Gyro-Sifter (Tokuju Corporation), Vibrasonic System (Dalton Corporation), Soniclean (Sintokogio, Ltd.), Turbo Screener (Turbo Kogyo Co., Ltd.), Microsifter (Makino Mfg. Co., Ltd.), and circular vibrating sieves.

Toner particle production by the emulsion aggregation method proceeds, for example, as follows.

The method of toner particle production by emulsion aggregation is preferably a toner production method that includes a step of aggregating resin fine particles and colorant fine particles wherein the resin fine particles contain the compound represented by general formula [1].

In specific terms, toner particles are produced through a step of aggregating colorant fine particles and resin fine particles that contain the compound represented by general formula [1], a fusion step, a cooling step, and a washing step. As desired, fine particles of the compound represented by formula [1] produced separately from the resin fine particles may be used. Also as desired, a shell formation step may be added after the cooling step to provide a core/shell toner particle.

<Step of Emulsifying Resin Fine Particles>

Resin fine particles containing the binder resin can be prepared by a known method. For example, a resin particle dispersion can be produced by adding the binder resin dissolved in an organic solvent to an aqueous medium; creating a particle dispersion in the aqueous medium, along with surfactant and/or a polyelectrolyte, using a disperser, e.g., a homogenizer; and then removing the solvent by heating or reducing the pressure. Any organic solvent that can dissolve the binder resin can be used as the organic solvent used to bring about dissolution, but tetrahydrofuran, ethyl acetate, chloroform, and so forth are preferred from the standpoint of the solubility.

With regard to the method of adding the compound represented by general formula [1], binder resin fine particles containing the compound represented by general formula [1] may be produced by dissolving the compound represented by general formula [1] in the organic solvent along with the binder resin.

In addition, emulsification and dispersion in an aqueous medium that substantially does not contain organic solvent can also be carried out by adding the binder resin and surfactant, base, and so forth to the aqueous medium and using a disperser that applies a high-speed shear force, e.g., Clearmix, homomixers, homogenizers, and so forth.

The pH in the aqueous medium is preferably made at least 8 in the emulsification step. Having the pH be at least 8 facilitates removal into the aqueous medium of the monomer component produced during emulsification. Any base can be used to adjust the pH, but sodium hydroxide and potassium hydroxide are preferred.

There are no particular limitations on the surfactant used for the emulsification, and this surfactant can be exemplified by anionic surfactants such as sulfate ester salts, sulfonic acid salts, carboxylic acid salts, phosphate esters, and soaps; cationic surfactants such as amine salts and quaternary ammonium salts; and nonionic surfactants such as polyethylene glycol types, ethylene oxide adducts on alkylphenols, and polyhydric alcohol types. A single surfactant may be used by itself or two or more may be used in combination.

The volume median diameter of the resin fine particles is preferably at least 0.05 μm and not more than 1.0 μm and is more preferably at least 0.05 μm and not more than 0.4 μm. A volume median diameter of not more than 1.0 μm facilitates obtaining toner particles having a volume median diameter of at least 4.0 μm and not more than 7.0 μm, which is a favorable volume median diameter for toner particles.

<Colorant Fine Particles>

The colorant fine particles are prepared by dispersing a colorant in an aqueous medium. The colorant can be dispersed by a known method, but, for example, a rotating shear-type homogenizer, a media-based disperser (e.g., a ball mill, sand mill, attritor, and so forth), or a high-pressure counter collision-type disperser is preferably used. In addition, a surfactant and/or polymeric dispersing agent that provides dispersion stability may be added as necessary. The colorants described above can be used as the colorant.

<Fine Particles of the Compound Represented by General Formula [1]>

Fine particles of the compound represented by formula [1] may be used in the emulsion aggregation method. These fine particles of the compound represented by general formula [1] are provided by dispersing the compound represented by general formula [1] in an aqueous medium. The compound represented by general formula [1] can be dispersed by a known method, but, for example, a rotating shear-type homogenizer, a media-based disperser (e.g., a ball mill, sand mill, attritor, and so forth), or a high-pressure counter collision-type disperser is preferably used. In addition, a surfactant and/or polymeric dispersing agent that provides dispersion stability may be added as necessary.

The particle size distribution of the resin fine particles, colorant fine particles, and fine particles of the compound represented by general formula [1] is analyzed by measurement using a laser diffraction/scattering particle diameter distribution analyzer (LA-950, Horiba, Ltd.) in accordance with the operating manual provided with the instrument. After an aqueous surfactant solution is added dropwise to the circulating water, the particular fine particle dispersion is added dropwise to reach the optimal concentration for the instrument; ultrasound dispersion is carried out for 30 seconds; and the measurement is started and the 50% cumulative particle diameter value (D50) and the 90% cumulative particle diameter value (D90) are determined.

<Aggregation Step>

The aggregation step is a step in which a liquid mixture is prepared by mixing the aforementioned resin fine particles and colorant fine particles and so forth in correspondence to their required amounts and then aggregating the particles present in the thusly prepared liquid mixture to form aggregates. In a favorable example of a method for forming the aggregates, for example, an aggregating agent is added to and mixed into the liquid mixture under the appropriate application of temperature, mechanical force, and so forth.

The aggregating agent used in the aggregation step can be exemplified by the metal salts of monovalent metals, e.g., sodium, potassium, and so forth; the metal salts of divalent metals, e.g., calcium, magnesium, and so forth; and the metal salts of trivalent metals, e.g., iron, aluminum, and so forth.

The addition and mixing of the aggregating agent is preferably carried out at a temperature that does not exceed the glass transition temperature (Tg) of the resin fine particles present in the liquid mixture. When this mixing is performed using this temperature condition, mixing then proceeds in a state in which aggregation is stable. This mixing may be carried out using a known mixing device, homogenizer, mixer, and so forth.

While there are no particular limitations on the average particle diameter of the aggregate formed here, this average particle diameter is preferably controlled to at least 4.0 μm and not more than 9.0 μm so as to be about the same as the average particle diameter of the toner particle that will be obtained. This control can be readily carried out by appropriately setting and varying the temperature during the addition and mixing of the aggregating agent and so forth and by appropriately setting and varying the conditions during the above-described stirring and mixing. The particle diameter distribution of the toner particles can be measured using a particle size distribution analyzer that employs the Coulter principle (Coulter Multisizer III: from Beckman Coulter, Inc.).

In addition, as in the emulsification step, the pH of the aqueous medium is preferably made at least 8 from the standpoint of dissolving and removing, into the aqueous medium, the monomer produced by hydrolysis of the polyester resin. Having the pH be at least 8 serves to inhibit precipitation of monomer released into the aqueous medium in the emulsification step and thus minimizes the risk of its incorporation into the toner.

<Fusion Step>

The fusion step is a step in which particles, provided by the smoothing of the aggregate surface, are produced by heating the aforementioned aggregates to at least the glass transition temperature (Tg) of the resin to effect fusion. In order to prevent melt adhesion between the toner particles, a chelating agent, pH modifier, surfactant, and so forth can be introduced as appropriate prior to entry into the primary fusion step.

The chelating agent can be exemplified by ethylenediaminetetraacetic acid (EDTA) and its salts with an alkali metal such as the Na salt, sodium gluconate, sodium tartrate, potassium citrate and sodium citrate, nitrilotriacetate (NTA) salts, and various water-soluble polymers that contain both the COOH and OH functionalities (polyelectrolytes).

The heating temperature should be between the glass transition temperature (Tg) of the resin present in the aggregates and the temperature at which the resin undergoes thermal decomposition, and is preferably a temperature equal to or greater than the melting points of the binder resin and the compound represented by general formula [1]. By having the temperature be equal to or greater than the melting points of the binder resin and compound represented by general formula [1], the compatibility between the binder resin and compound represented by general formula [1] is improved and in addition smoothing of the aggregate surface can proceed more efficiently. The time period for heating/ fusion must be a shorter time when a higher heating temperature is used and a longer time when a lower heating temperature is used. That is, the heating•fusion time, while it cannot be unconditionally specified because it depends on the heating temperature, is generally at least 10 minutes and not more than 10 hours.

<Cooling Step>

The cooling step is a step in which the temperature of the particle-containing aqueous medium is cooled to a temperature below the glass transition temperature (Tg) of the binder resin. The production of coarse particles can be suppressed by carrying out cooling to a temperature below this Tg. The specific cooling rate is preferably at least 0.1° C./min and not more than 50° C./min.

<Shell Formation Step>

As necessary, a shell formation step can also be inserted in the present invention before the washing and drying step described below. The shell formation step is a step in which a shell is formed by the fresh addition and attachment of resin fine particles to the particles produced by the steps up to this point.

The resin fine particles added here may have the same structure as the resin fine particles used for the core or may be resin fine particles having a different structure.

There are no particular limitations on the resin constituting the shell layer, and the resins known for use in toners can be used, for example, polyester resins, vinyl polymers such as styrene-acrylic copolymers, epoxy resins, polycarbonate resins, and polyurethane resins. Polyester resins and styrene-acrylic copolymers are preferred among the preceding and polyester resins are more preferred from the standpoint of the fixing performance and durability. A polyester resin that has a rigid aromatic ring in the main chain has a flexibility comparable to that of vinyl polymers such as styrene-acrylic copolymers and as a consequence can provide the same mechanical strength at a lower molecular weight than a vinyl polymer. Due to this, polyester resins are also preferred as resins adapted for low-temperature fixability.

A single binder resin may be used to form the shell layer in the present invention or a combination of two or more may be used.

<Washing and Drying Step>

Toner particles can be obtained by subjecting the particles produced by the previously described steps to washing, filtration, drying, and so forth. Preferably filtration and washing are carried out using deionized water having a pH adjusted with sodium hydroxide or potassium hydroxide followed by carrying out washing with deionized water and filtration a plurality of times. With this method, the monomer component produced by hydrolysis can be efficiently removed by carrying out washing.

A toner particle can be obtained by the emulsion aggregation method using the steps described above, and a toner can also be obtained optionally by mixing the toner particles with external additive using a mixer such as a Henschel mixer.

Toner particle production by the suspension polymerization method proceeds, for example, as follows.

The method of toner particle production by suspension polymerization is preferably a production method in which toner particles are obtained by forming, in an aqueous medium, particles of a polymerizable monomer composition that contains colorant and the polymerizable monomer that will form the binder resin, and polymerizing the polymerizable monomer present in these particles, wherein the polymerizable monomer composition contains the compound represented by general formula [1].

Toner particles can be obtained preferably by the filtration, washing, and drying of the particles yielded by the polymerization of the polymerizable monomer composition particles. As necessary, residual polymerizable monomer may be removed by carrying out a distillation after the polymerization.

The polymerizable monomer can be exemplified by the vinyl monomers used in polymerization to give the previously described styrene copolymer resin, wherein the use of styrene monomers and acrylic acid monomers is particularly preferred. In addition, the crosslinking monomers used in polymerization to give the styrene copolymer resin may be used in combination therewith.

The polymerization initiator that can be used in the polymerization of the polymerizable monomer may be added at the same time as the addition of other additives to the polymerizable monomer or may be added immediately prior to the formation of the polymerizable monomer composition particles in the aqueous medium. The polymerization initiator may also be added, dissolved in the polymerizable monomer or solvent, immediately after the formation of the polymerizable monomer composition particles but prior to the initiation of the polymerization reaction.

The polymerization initiators used for the polymerization of the styrene copolymer resin may be used as the polymerization initiator here. The particular polymerization initiator is selected considering the 10-hour half-life temperature. A single polymerization initiator may be used or two or more may be used.

The use amount for the polymerization initiator is preferably at least 3.0 mass parts and not more than 20.0 mass parts per 100.0 mass parts of the polymerizable monomer.

The dispersing agent used to disperse the polymerizable monomer composition in the aqueous medium can be an inorganic dispersion stabilizer or an organic dispersion stabilizer.

The inorganic dispersion stabilizers can be exemplified by tricalcium phosphate, magnesium phosphate, aluminum phosphate, zinc phosphate, magnesium carbonate, calcium carbonate, calcium hydroxide, magnesium hydroxide, aluminum hydroxide, calcium metasilicate, calcium sulfate, barium sulfate, bentonite, silica, and alumina.

The organic dispersion stabilizers can be exemplified by polyvinyl alcohol, gelatin, methyl cellulose, methylhydroxypropyl cellulose, ethyl cellulose, the sodium salt of carboxymethyl cellulose, and starch.

A nonionic, anionic, or cationic surfactant may also be used as the dispersion stabilizer.

The surfactant can be exemplified by sodium dodecyl sulfate, sodium tetradecyl sulfate, sodium pentadecyl sulfate, sodium octyl sulfate, sodium oleate, sodium laurate, potassium stearate, and calcium oleate.

A sparingly water-soluble inorganic dispersion stabilizer is preferred among these dispersion stabilizers. A sparingly water-soluble inorganic dispersion stabilizer that is soluble in acid is more preferred.

The amount of use of the dispersion stabilizer is preferably at least 0.2 mass parts and not more than 2.0 mass parts per 100.0 mass parts of the polymerizable monomer.

The aqueous medium is preferably prepared using at least 300 mass parts and not more than 3,000 mass parts of water per 100 mass parts of the polymerizable monomer composition.

When an aqueous medium is prepared with a sparingly water-soluble inorganic dispersion stabilizer dispersed therein, the dispersion stabilizer as such may be dispersed in the liquid medium, e.g., water. In addition, in order to obtain dispersion stabilizer particles that have a fine and uniform particle size, the aqueous medium may be prepared by producing the sparingly water-soluble inorganic dispersion stabilizer by adding the starting materials for the sparingly water-soluble inorganic dispersion stabilizer to the liquid medium, e.g., water, under high-speed stirring. For example, when tricalcium phosphate, which is a sparingly water-soluble inorganic dispersion stabilizer, is used as the dispersion stabilizer, finely divided particles of tricalcium phosphate can be formed by mixing an aqueous sodium phosphate solution with an aqueous calcium chloride solution under high-speed stirring.

A shell layer may be formed on the toner particle surface in the present invention. The method for attaching resin particles in order to form the shell layer can be, for example, a method in which attachment is induced by a mechanical treatment by dry mixing the toner particles with the resin particles. Another example is a method in which the toner particles and resin particles are dispersed in an aqueous medium and heating is carried out and/or an aggregating agent is added. In order to bring about a uniform attachment of the resin particles to the toner particle surface and suppress variability among the toner particles, the resin particles are preferably attached to the surface of the toner base particle in an aqueous medium by the application of heat.

Toner particles can be obtained by the suspension polymerization method using the steps indicated above, and a toner can also be obtained optionally by mixing the toner particles with external additive using a mixer such as a Henschel mixer.

Toner particle production by the dissolution suspension method proceeds, for example, as follows.

The method of toner particle production by dissolution suspension is a toner particle production method that contains a granulation step and a solvent removal step. In the granulation step, a toner particle composition containing the binder resin, colorant, and compound represented by general formula [1] is dispersed or dissolved in an organic solvent to prepare a mixed resin solution, and this mixed resin solution is dispersed in an aqueous medium and particles of the mixed resin solution are formed. In the solvent removal step, toner particles are obtained by removing the organic solvent present in the particles in the mixed resin solution.

<Step of Preparing the Mixed Resin Solution>

The gradual addition of the binder resin, colorant, compound represented by general formula [1], and so forth to the organic solvent while stirring to bring about dissolution or dispersion may be used for the method of producing the mixed resin solution in which the toner particle composition containing the binder resin, colorant, compound represented by general formula [1], and so forth is dispersed or dissolved in organic solvent.

A uniform miscibilization between the binder resin and the compound represented by general formula [1] is achieved by dissolving the binder resin and the compound represented by general formula [1] in organic solvent. On the other hand, when a pigment is used as colorant or when, for example, a release agent or charge control agent that is sparingly soluble in the organic solvent is added, the particles thereof preferably are finely comminuted prior to addition to the organic solvent. A known disperser, e.g., a bead mill, disk mill, and so forth, can be used for dispersion.

<Granulation Step>

An aqueous dispersion of a toner particle composition is prepared by dispersing the mixed resin solution provided by the previous step into an aqueous medium that contains at least a surfactant or an inorganic dispersion stabilizer. When a modified resin having a segment capable of reacting with an active hydrogen group-bearing compound has been added to the toner particle composition, an active hydrogen group-bearing compound may then be added to the toner particle composition and the aqueous dispersion of the toner particle composition may be formed while producing the binder resin by reacting the active hydrogen group-bearing compound with the modified resin in the aqueous medium.

The active hydrogen group in the active hydrogen group-bearing compound can be, for example, the hydroxyl group (alcoholic hydroxyl group or phenolic hydroxyl group), amino group, carboxyl group, or mercapto group. A single active hydrogen group-bearing compound may be used by itself or two or more may be used in combination.

The apparatus used in the granulation step can be, for example, a vertical stirred tank equipped with a stirrer that develops a high shear force. A commercial product, such as a High-Shear Mixer (IKA® Werke GmbH & Co. KG), T. K. Homomixer (Tokushu Kika Kogyo Co., Ltd.), T. K. Filmix (Tokushu Kika Kogyo Co., Ltd.), or Clearmix (M Technique Co., Ltd.), can be used as the stirrer that develops a high shear force.

The surfactant can be exemplified by anionic surfactants such as alkylbenzenesulfonate salts, α-olefinsulfonate salts, and phosphate esters; cationic surfactants, e.g., amine salt types such as alkylamine salts, aminoalcohol/fatty acid derivatives, polyamine/fatty acid derivatives, and imidazoline, and quaternary ammonium salt types such as alkyltrimethylammonium salts, dialkyldimethylammonium salts, alkyldimethylbenzylammonium chloride, pyridinium salts, alkylisoquinolinium salts, and benzethonium chloride; nonionic surfactants such as fatty acid amide derivatives and polyhydric alcohol derivatives; and amphoteric surfactants, for example, alanine, dodecyldi(aminoethyl)glycine, di(octylaminoethyl)glycine, and N-alkyl-N,N-dimethylammonium betaine. A single one of these may be used or a combination of two or more may be used.

The inorganic dispersion stabilizer used in toner particle production by the dissolution suspension method can be the same as in the suspension polymerization method, and a single one can be used or a combination of two or more can be used.

<Solvent Removal Step>

In the solvent removal step, the organic solvent is removed from the resulting aqueous dispersion of the toner particle composition. In order to remove the organic solvent, a method can be used in which the entire system is gradually heated while being stirred in order to completely evaporatively remove the organic solvent in the liquid droplets. Alternatively, the organic solvent can be evaporatively removed by reducing the pressure while stirring the aqueous dispersion of the toner particle composition.

<Maturation Step>

When a modified resin having a segment capable of reacting with an active hydrogen group-bearing compound, e.g., the isocyanate group in terminal position, has been added, a maturation step may be carried out in order to develop the extension/crosslinking reactions of the isocyanate. The maturation time is generally 10 minutes to 40 hours and is preferably 2 to 24 hours. The maturation temperature is generally 0° C. to 65° C. and is preferably 35° C. to 50° C.

Toner particles can be obtained by the dissolution suspension method using the steps indicated above, and a toner can also be obtained optionally by mixing the toner particles with external additive using a mixer such as a Henschel mixer.

The method for measuring the particle size distribution of the toner in accordance with the present invention is described in the following.

<Measurement of the Weight-Average Particle Diameter (D4) of the Toner>

The weight-average particle diameter (D4) of the toner is determined using a "Coulter Counter Multisizer 3®" (from Beckman Coulter, Inc.), a precision particle size distribution measurement instrument operating on the pore electrical resistance method and equipped with a 100 μm aperture tube, and using the accompanying dedicated software, i.e., "Beckman Coulter Multisizer 3 Version 3.51" (from Beckman Coulter, Inc.), to set the measurement conditions and analyze the measurement data; the measurements are carried out in 25,000 channels for the number of effective measurement channels and the measurement data is analyzed.

The aqueous electrolyte solution used for the measurements is prepared by dissolving special-grade sodium chloride in deionized water to provide a concentration of approximately 1 mass % and, for example, "ISOTON II" (from Beckman Coulter, Inc.) can be used.

The dedicated software is configured as follows prior to measurement and analysis.

In the "modify the standard operating method (SOM)" screen in the dedicated software, the total count number in the control mode is set to 50,000 particles; the number of measurements is set to 1 time; and the Kd value is set to the value obtained using "standard particle 10.0 μm" (from Beckman Coulter, Inc.). The threshold value and noise level are automatically set by pressing the threshold value/noise level measurement button. In addition, the current is set to 1600 μA; the gain is set to 2; the electrolyte is set to ISOTON II; and a check is entered for the post-measurement aperture tube flush.

In the "setting conversion from pulses to particle diameter" screen of the dedicated software, the bin interval is set to logarithmic particle diameter; the particle diameter bin is set to 256 particle diameter bins; and the particle diameter range is set to 2 μm to 60 μm.

The specific measurement procedure is as follows.

(1) Approximately 200 mL of the above-described aqueous electrolyte solution is introduced into a 250-mL roundbottom glass beaker intended for use with the Multisizer 3 and this is placed in the sample stand and counterclockwise stirring with the stirrer rod is carried out at 24 rotations per second. Contamination and air bubbles within the aperture tube are preliminarily removed by the "aperture flush" function of the dedicated software.

(2) Approximately 30 mL of the above-described aqueous electrolyte solution is introduced into a 100-mL flatbottom glass beaker. To this, is added, as an dispersing agent approximately 0.3 mL of a dilution prepared by the threefold (mass) dilution with deionized water of "Contaminon N" (a 10 mass % aqueous solution of a neutral pH 7 detergent for cleaning precision measurement instrumentation, comprising a nonionic surfactant, anionic surfactant, and organic builder, from Wako Pure Chemical Industries, Ltd.).

(3) A prescribed amount of deionized water is introduced into the water tank of an "Ultrasonic Dispersion System Tetora 150" (Nikkaki Bios Co., Ltd.), which is an ultrasound disperser with an electrical output of 120 W that is equipped with two oscillators (oscillation frequency=50 kHz) disposed such that the phases are displaced by 180°, and approximately 2 mL of Contaminon N is added to this water tank.

(4) The beaker described in (2) is set into the beaker holder opening on the ultrasound disperser and the ultrasound disperser is started. The vertical position of the beaker is adjusted in such a manner that the resonance condition of the surface of the aqueous electrolyte solution within the beaker is at a maximum.

(5) While the aqueous electrolyte solution within the beaker set up according to (4) is being irradiated with ultrasound, approximately 10 mg of the toner is added to the aqueous electrolyte solution in small portions and dispersion is carried out. The ultrasound dispersion treatment is continued for an additional 60 seconds. The water temperature in the water tank is controlled as appropriate during ultrasound dispersion to be at least 10° C. and not more than 40° C.

(6) Using a pipette, the dispersed toner-containing aqueous electrolyte solution prepared in (5) is dripped into the roundbottom beaker set in the sample stand as described in (1) with adjustment to provide a measurement concentration of approximately 5%. Measurement is then performed until the number of measured particles reaches 50,000.

(7) The measurement data is analyzed by the previously cited dedicated software provided with the instrument and the weight-average particle diameter (D4) is calculated. When set to graph/volume % with the dedicated software, the "average diameter" on the analysis/volumetric statistical value (arithmetic average) screen is the weight-average particle diameter (D4).

The method for verifying the plasticizing effect for the binder resin and the compatibility, of the compound represented by general formula [1] and other additive is described in the following.

1) Method for Verifying the Plasticizing Effect

The plasticizing effect is verified by measuring the glass transition temperature Tg of the toner containing the compound represented by general formula [1] or other additive and the toner lacking same. The glass transition temperature Tg is measured based on ASTM D 3418-82 using a "Q1000" differential scanning calorimeter (TA Instruments). The melting points of indium and zinc are used for temperature correction in the detection section of the instrument, and the heat of fusion of indium is used for correction of the amount of heat.

Specifically, approximately 3 mg of the particular sample is exactly weighed and this is introduced into an aluminum pan. Using an empty aluminum pan for reference, the measurement is carried out at a ramp rate of 10° C./min in the measurement range of 20° C. to 200° C. Using 20° C. to 200° C. for the measurement temperature range, heating is first carried out from 20° C. to 200° C. at a ramp rate of 10° C./min followed by cooling from 200° C. to 20° C. at a ramp down rate of 10° C./min and then reheating to 200° C. at a ramp rate of 10° C./min.

Using the DSC curve obtained in the second heating process, the glass transition temperature Tg of the particular toner is taken to be the point at the intersection between the differential heat curve and the line for the midpoint for the baselines for prior to and subsequent to the appearance of the change in the specific heat. Here, the difference in the glass transition temperature Tg between the toner containing the compound represented by general formula [1] or other additive and the toner lacking same is measured, and the plasticizing effect is verified using this difference. A larger difference in the glass transition temperatures Tg for a particular toner is indicative of a greater plasticizing effect.

2) Method for Verifying the Compatibility

The compatibility is verified by measuring the endothermic quantity for the compound represented by general formula [1] or other additive and for the toner containing the compound represented by general formula [1] or other additive. The endothermic quantity is measured based on ASTM D 3418-82 using a "Q1000" differential scanning calorimeter (TA Instruments). The melting points of indium and zinc are used for temperature correction in the detection section of the instrument, and the heat of fusion of indium is used for correction of the amount of heat.

Specifically, approximately 3 mg of the particular sample is exactly weighed and this is introduced into an aluminum pan. Using an empty aluminum pan for reference, the measurement is carried out at a ramp rate of 10° C./min in the measurement range of 20° C. to 200° C. Using 20° C. to 200° C. for the measurement temperature range, heating is first carried out from 20° C. to 200° C. at a ramp rate of 10° C./min followed by cooling from 200° C. to 20° C. at a ramp down rate of 10° C./min and then reheating to 200° C. at a ramp rate of 10° C./min.

For the compound represented by general formula [1] or other additive, the compatibility is verified by measuring, in the temperature range from 20° C. to 200° C. in the second heating process, the endothermic quantity originating with the compound represented by general formula [1] or other additive present in the toner. A smaller endothermic quantity originating from the compound represented by general formula [1] or other additive is indicative of a higher compatibility.

In the present invention, the endothermic quantity originating with the compound represented by general formula [1] present in the toner is preferably not more than 1.0 J/g and more preferably not more than 0.5 J/g.

EXAMPLES

The basic constitution and features of the invention of the present application are described in the preceding, while the invention of the present application is specifically described in the following based on examples. However, the invention of the present application is in no way limited to these. Unless specifically indicated otherwise, parts and % are on a mass basis.

Binder Resin 1 Production Example

| | |
|---|---|
| propylene oxide adduct on bisphenol A (average number of moles of addition: 2.2 mol) | 117 parts |
| ethylene oxide adduct on bisphenol A (average number of moles of addition: 2.2 mol) | 62 parts |
| isophthalic acid | 390 parts |
| n-dodecenylsuccinic acid | 360 parts |
| trimellitic anhydride | 19 parts |

2 parts of dibutyltin oxide per 100 parts of the total acid component was added to the indicated monomer, and a binder resin 1 was obtained by reacting for 6 hours at 220° C. under a nitrogen current while stirring. The softening point was 135° C. and Tg was 65° C.

Binder Resin 2 Production Example

| | |
|---|---|
| styrene | 70 parts |
| n-butyl acrylate | 24 parts |
| monobutyl maleate | 6 parts |
| di-t-butyl peroxide | 1 part |

This monomer was added dropwise over 4 hours to 200 parts of xylene. The polymerization was finished under a xylene reflux. This was followed by heating and distillative removal of the organic solvent and pulverization after cooling to room temperature to obtain a binder resin 2. The softening point was 125° C. and Tg was 60° C.

Example A-1

Toner A-1 Production Example

| | |
|---|---|
| binder resin 1 | 100 parts |
| compound represented by general formula [1] (9-fluorenone, melting point: 84° C.) | 3 parts |
| C.I. Pigment Blue 15:3 | 4 parts |
| aluminum 3,5-di-tert-butylsalicylate compound | 0.5 parts |

These materials were pre-mixed using a Henschel mixer and were then melt-kneaded using a twin-screw kneader extruder.

The obtained kneaded material was cooled and then coarsely pulverized with a hammer mill and subsequently pulverized with a jet mill; the resulting finely pulverized powder was classified using a multi-grade classifier based on the Coanda effect to obtain a toner particle having a negative tribocharging behavior and a weight-average particle diameter (D4) of 6.8 μm. 1.0 part of a hydrophobic silica fine powder (specific surface area by nitrogen adsorption measured by the BET method=140 $m^2/g$) and 3.0 parts of strontium titanate (volume-average particle diameter=1.6 μm) were externally added and mixed with 100 parts of this toner particle followed by screening on a mesh with an aperture of 150 μm to obtain a toner A-1.

Verification of the plasticizing effect and compatibility was carried out on toner A-1. As a comparative toner, a toner was prepared without the addition of the compound represented by general formula [1] (9-fluorenone, melting point: 84° C.) to the aforementioned mixture. This toner is designated toner a-1.

For verification of the plasticizing effect, the glass transition temperature Tg of toner A-1 and toner a-1 was measured using a "Q1000" differential scanning calorimeter. The glass transition temperature Tg of toner A-1 was 53° C. and the glass transition temperature Tg of toner a-1 was 61° C. These results demonstrated that a plasticizing effect of 8° C. in terms of the Tg was obtained by the addition of 3 parts of 9-fluorenone.

Then, to verify the compatibility, the endothermic peaks of 9-fluorenone and toner A-1 were measured using a "Q1000" differential scanning calorimeter. A sharp endothermic peak was observed at 84° C. for 9-fluorenone. On the other hand, an endothermic peak was not seen with toner A-1 in the measurement temperature range, and the compatibilization of all the 9-fluorenone was thus confirmed.

Based on the preceding, 9-fluorenone was confirmed to have a high plasticizing effect for and compatibility with binder resin 1.

Magnetic Carrier Production Example

Water was added to 100 parts of $Fe_2O_3$ and milling was carried out for 15 minutes with a ball mill to produce a magnetic core having an average particle diameter of 55 μm.

Then, a liquid mixture of 1.0 part of a straight silicone resin (Shin-Etsu Chemical Co., Ltd.: KR271), 0.5 parts of γ-aminopropyltriethoxysilane, and 98.5 parts of toluene was added to 100 parts of this magnetic core and pressure reduction and drying were carried out for 5 hours at 70° C.

while stirring and mixing with a solution decompression kneader to remove the solvent. After this, a baking treatment was performed for 2 hours at 140° C. followed by sieving with a sieve shaker (Model 300MM-2, Tsutsui Scientific Instruments Co., Ltd.: 75 μm aperture) to obtain a magnetic carrier.

<Production of Developer A-1>

Using a V-mixer (Model V-10, Tokuju Corporation) and conditions of 0.5 $s^{-1}$ and a rotation time of 5 minutes, toner A-1 and the magnetic carrier were mixed at 10.0 mass parts of toner A-1 per 1.0 mass part of the carrier to produce a developer A-1.

An imageRUNNER ADVANCE C5255 full-color copier from Canon, Inc. was used as the image-forming apparatus in the evaluation. The paper used in the evaluation was CS-814 (81.4 g/$m^2$) laser printer paper in A4 size.

The image density was measured with a color reflection densitometer (X-Rite 504, X-Rite Incorporated).

<Image Density in a Normal-Temperature, Normal-Humidity Environment>

With regard to the test conditions, the image density of a solid black image was measured after running a 500,000-print continuous paper feed test using a test chart with a 50% print percentage in a normal-temperature, normal-humidity environment (temperature 23° C./humidity 50% RH).

<Evaluation of Fixing Member Contamination>

The test conditions were as follows: a 500,000-print continuous paper feed test was run in a low-temperature, low-humidity environment (temperature 10° C./humidity 15% RH) using an original chart with a 50% print percentage. Following this, the image density of a solid black image was measured and the status of contamination around the fixing unit was visually evaluated using the following criteria.

A: Contamination is not seen around the fixing unit.
B: Very minor contamination is observed around the fixing unit.
C: Contamination is observed around the fixing unit.
D: Contamination is seen broadly around the fixing unit.

<Evaluation of the Halftone Non-Uniformity>

A 300,000-print continuous paper feed test was run in a high-temperature, high-humidity (32° C., 80% RH) environment using a test chart with a 5% print percentage. This was followed by measurement of the image density of a solid black image and visual evaluation of a 2-dot 3-space halftone image (tone non-uniformity of development) at a resolution of 600 dpi.

A: Tone non-uniformity is not detected.
B: Very minor tone non-uniformity is seen, but is almost imperceptible.
C: Some tone non-uniformity is seen.
D: Tone non-uniformity is conspicuous.

<Evaluation of the Low-Temperature Fixability>

A modified imageRUNNER ADVANCE C5255 full-color copier from Canon, Inc. was used as the image-forming apparatus in the evaluation. The modification made possible single-color operation with cyan toner. Another modification made it possible to freely alter the temperature at the fixing unit.

The low-temperature fixability was evaluated in a low-temperature, low-humidity (5° C., 5% RH) environment. A halftone patch with a size of 20 mm×20 mm was evenly written on A3 paper at 9 points, and the developing bias was set to provide an image density of 0.6. Then, after cooling so the temperature of the pressure roller in the fixing unit reached 5° C. or less, 20 single-sided prints were produced by continuous paper feed. The first, third, fifth, tenth, and twentieth prints were sampled out as samples for the evaluation of the low-temperature fixability, and the obtained fixed images were rubbed with lens-cleaning paper in 5 back-and-forth excursions applying a load of 4.9 kPa to the fixed image. The worst value, among the 5 samples, of the average value at the 9 points of the percentage decline in the image density pre-versus-post-rubbing was taken to be the percentage decline in the image density at the particular temperature. The fixing temperature was changed in 5° C. steps from 160° C. to 175° C., and the fixing onset temperature was taken to be the fixing temperature at which the percentage decline in the image density became equal to or less than 10%. The low-temperature fixability was evaluated based on this fixing onset temperature.

(Evaluation Criteria)

A: The fixing onset temperature is 160° C.
B: The fixing onset temperature is 165° C.
C: The fixing onset temperature is 170° C.
D: The fixing onset temperature is 175° C.

The developer in Example A-1 was scored with an "A" in all of the items evaluated as described above.

Toner A-2 Production Example

| | |
|---|---|
| binder resin 2 | 100 parts |
| compound represented by general formula [1] (2-amino-9-fluorenone, melting point: 156° C.) | 5 parts |
| C.I. Pigment Blue 15:3 | 4 parts |
| aluminum 3,5-di-tert-butylsalicylate compound | 0.5 parts |

These materials were pre-mixed using a Henschel mixer and were then melt-kneaded using a twin-screw kneader extruder.

The obtained kneaded material was cooled and then coarsely pulverized with a hammer mill and subsequently pulverized with a jet mill; the resulting finely pulverized powder was classified using a multi-grade classifier based on the Coanda effect to obtain a toner particle having a negative tribocharging behavior and a weight-average particle diameter (D4) of 6.8 μm. 1.0 part of a hydrophobic silica fine powder (specific surface area by nitrogen adsorption measured by the BET method=140 $m^2$/g) and 3.0 parts of strontium titanate (volume-average particle diameter=1.6 μm) were externally added and mixed with 100 parts of this toner particle followed by screening on a mesh with an aperture of 150 μm to obtain a toner A-2. The glass transition temperature Tg of toner A-2 was 50° C., and an endothermic peak was not seen in the measurement temperature range and the compatibilization of all the 2-amino-9-fluorenone was thus confirmed.

Toner A-3 to A-20 Production Example

Toners A-3 to A-20 were obtained proceeding as in the Toner A-1 Production Example, but changing the type and amount of addition of the compound represented by general formula [1] as shown in Table 1. The glass transition temperature Tg is given in Table 1 for toners A-3 to A-20. The Tg of toners A-3 to A-20 was in all instances lower than the 61° C. Tg of toner a-1, and based on this a plasticizing effect was confirmed for the compounds indicated in Table 1. In addition, an endothermic peak was not seen in the measurement temperature range for toners A-3 to A-20, and the compatibilization of all of the compound represented by general formula [1] was thus confirmed.

Developer A-2 to A-20 Production Example

Developers A-2 to A-20 were obtained proceeding as for the developer A-1, but using A-2 to A-20 for the toner as shown in Table 1.

TABLE 1

| Developer No. | Toner No. | compound represented by general formula [1] | boiling point (° C.) | melting point (° C.) | amount of addition (parts) | Tg (° C.) |
|---|---|---|---|---|---|---|
| A-1 | A-1 | 9-fluorenone | 342 | 84 | 3 | 53 |
| A-2 | A-2 | 2-amino-9-fluorenone | 426 | 156 | 5 | 50 |
| A-3 | A-3 | 2-bromo-9-fluorenone | 393 | 147 | 1 | 58 |
| A-4 | A-4 | 2-fluorenecarboxaldehyde | 367 | 84 | 1 | 59 |
| A-5 | A-5 | 2-iodo-9,9-dimethylfluorene | 377 | 66 | 1 | 58 |
| A-6 | A-6 | 2-bromo-9,9-dimethylfluorene | 353 | 69 | 1 | 57 |
| A-7 | A-7 | 9-phenyl-9-fluorenol | 436 | 110 | 1 | 57 |
| A-8 | A-8 | 9-fluorenylmethanol | 337 | 105 | 1 | 58 |
| A-9 | A-9 | 9-bromofluorene | 328 | 104 | 1 | 59 |
| A-10 | A-10 | 2-aminofluorene | 378 | 127 | 1 | 58 |
| A-11 | A-11 | 2,7-di-tert-butylfluorene | 372 | 124 | 1 | 57 |
| A-12 | A-12 | 2-iodofluorene | 376 | 130 | 1 | 57 |
| A-13 | A-13 | 9-fluorenol | 368 | 155 | 1 | 58 |
| A-14 | A-14 | 2-acetylfluorene | 381 | 130 | 1 | 58 |
| A-15 | A-15 | 2-amino-9,9-dimethylfluorene | 374 | 168 | 1 | 57 |
| A-16 | A-16 | fluorene | 298 | 116 | 10 | 45 |
| A-17 | A-17 | 2-fluorofluorene | 299 | 98 | 0.2 | 60 |
| A-18 | A-18 | 9,9-dimethylfluorene | 287 | 97 | 0.1 | 60 |
| A-19 | A-19 | 9,9-dimethylfluorene | 287 | 97 | 20 | 40 |
| A-20 | A-20 | dibenzofuran | 285 | 83 | 22 | 39 |

Examples A-2 to A-20

Developers A-2 to A-20 were evaluated using the same methods as in Example 1. The results of these evaluations are given in Table 2.

TABLE 2

| Example No. | Developer No. | fixing member contamination | halftone non-uniformity | low-temperature fixability | reflection density NN | HH | LL |
|---|---|---|---|---|---|---|---|
| A-1 | A-1 | A | A | A | 1.48 | 1.47 | 1.48 |
| A-2 | A-2 | A | A | A | 1.48 | 1.47 | 1.48 |
| A-3 | A-3 | A | A | A | 1.48 | 1.47 | 1.48 |
| A-4 | A-4 | A | A | B | 1.48 | 1.47 | 1.48 |
| A-5 | A-5 | A | A | B | 1.48 | 1.47 | 1.48 |
| A-6 | A-6 | A | A | B | 1.48 | 1.47 | 1.48 |
| A-7 | A-7 | A | A | B | 1.48 | 1.47 | 1.48 |
| A-8 | A-8 | A | A | B | 1.48 | 1.47 | 1.48 |
| A-9 | A-9 | A | A | B | 1.48 | 1.47 | 1.48 |
| A-10 | A-10 | A | A | B | 1.48 | 1.47 | 1.48 |
| A-11 | A-11 | A | A | B | 1.48 | 1.47 | 1.48 |
| A-12 | A-12 | A | A | B | 1.48 | 1.47 | 1.48 |
| A-13 | A-13 | A | A | B | 1.48 | 1.47 | 1.48 |
| A-14 | A-14 | A | A | B | 1.48 | 1.47 | 1.48 |

TABLE 2-continued

| Example No. | Developer No. | fixing member contamination | halftone non-uniformity | low-temperature fixability | reflection density NN | HH | LL |
|---|---|---|---|---|---|---|---|
| A-15 | A-15 | A | A | B | 1.48 | 1.47 | 1.48 |
| A-16 | A-16 | B | A | B | 1.48 | 1.45 | 1.48 |
| A-17 | A-17 | B | A | B | 1.48 | 1.45 | 1.48 |
| A-18 | A-18 | B | B | C | 1.46 | 1.45 | 1.46 |
| A-19 | A-19 | C | B | C | 1.46 | 1.45 | 1.46 |
| A-20 | A-20 | C | C | C | 1.46 | 1.45 | 1.46 |

In table 2, NN indicates "normal temperature, normal humidity", HH indicates "high temperature, high humidity" and LL indicates "low temperature, low humidity".

Developer A-21 to A-27 Production Example

Toners A-21 to A-27 were obtained proceeding as in the Toner A-1 Production Example, but adding the compounds given in Table 3 in place of the compound represented by general formula [1]. In addition, developers A-21 to A-27 were obtained proceeding as for developer A-1, but changing the toner to A-21 to A-27 as shown in Table 3.

TABLE 3

| Developer No. | Toner No. | compound added in place of the compound represented by general formula [1] | melting point (° C.) | amount of addition (parts) | Tg (° C.) |
|---|---|---|---|---|---|
| A-21 | A-21 | bisphenoxyethanolfluorene | 120 | 15 | 51 |
| A-22 | A-22 | paraffin wax | 78 | 3 | 60 |
| A-23 | A-23 | polyethylene wax | 88 | 3 | 60 |
| A-24 | A-24 | Fischer-Tropsch wax | 77 | 3 | 60 |
| A-25 | A-25 | ester wax | 77 | 3 | 55 |
| A-26 | A-26 | higher alcohol wax | 78 | 3 | 53 |
| A-27 | A-27 | saturated straight-chain fatty acid | 80 | 3 | 54 |

Comparative Examples A-1 to A-7

Developers A-21 to A-27 were evaluated by the same methods as in Example A-1. The results of these evaluations are given in Table 4.

TABLE 4

| Comparative Example No. | Developer No. | fixing member contamination | halftone non-uniformity | low-temperature fixability | reflection density NN | HH | LL |
|---|---|---|---|---|---|---|---|
| A-1 | A-21 | C | D | C | 1.44 | 1.43 | 1.44 |
| A-2 | A-22 | D | D | D | 1.44 | 1.43 | 1.44 |
| A-3 | A-23 | D | D | D | 1.44 | 1.43 | 1.44 |
| A-4 | A-24 | D | D | D | 1.44 | 1.43 | 1.44 |
| A-5 | A-25 | D | D | D | 1.44 | 1.43 | 1.44 |
| A-6 | A-26 | D | D | D | 1.44 | 1.43 | 1.44 |
| A-7 | A-27 | D | D | D | 1.44 | 1.43 | 1.44 |

In table 4, NN indicates "normal temperature, normal humidity", HH indicates "high temperature, high humidity" and LL indicates "low temperature, low humidity".

Example B-1

Preparation of Resin Fine Particle Dispersion 1

| | |
|---|---|
| binder resin 1 | 1200 parts |
| 9-fluorenone | 36 parts |
| anionic surfactant (DKS Co. Ltd.: Neogen SC-A) | 0.5 parts |
| tetrahydrofuran | 2400 parts |

These components were combined and stirred for 10 minutes. Then, 3600 parts of deionized water was added dropwise while stirring at 5,000 rpm using a homogenizer (IKA® Werke GmbH & Co. KG: Ultra-Turrax T50). The THF was removed by treating the obtained mixture at 50° C. under reduced pressure (50 mmHg), thus yielding a resin fine particle dispersion 1. The obtained resin fine particles had a D50 of 0.12 μm and a D90 of 0.16 μm.

(Preparation of Colorant Fine Particle Dispersion)

| | |
|---|---|
| C.I. Pigment Blue 15:3 | 100 parts |
| anionic surfactant (DKS Co. Ltd.: Neogen RK) | 15 parts |
| deionized water | 885 parts |

The preceding were mixed and were dispersed for 1 hour using a Nanomizer (Yoshida Kikai Co., Ltd.), a high-pressure impact-type disperser, to prepare an aqueous dispersion of colorant fine particles in which the colorant was dispersed. The colorant fine particles had a D50 of 0.19 μm and a D90 of 0.26 μm.

Toner B-1 Production Example

| | |
|---|---|
| resin fine particle dispersion 1 | 600 parts |
| colorant fine particle dispersion | 60 parts |
| 1 mass % aqueous magnesium sulfate solution | 150 parts |
| deionized water | 515 parts |

These components were introduced into a round stainless steel flask and were mixed and dispersed for 10 minutes at 5,000 rpm using a homogenizer (IKA® Werke GmbH & Co. KG: Ultra-Turrax T50); this was followed by heating to 43° C. on a heating oil bath and, using a stirring blade, adjusting the rotation as appropriate so as to stir the mixture. Aggregate particles were formed by holding for 1 hour at 43° C.

An aqueous solution prepared by the dissolution of 15 parts of trisodium citrate in 285 parts of deionized water was then added followed by heating to 90° C. while continuing to stir and holding for 3 hours. After this, cooling to room temperature was carried out followed by filtration, thorough washing of the residue with deionized water, and drying using a vacuum dryer to obtain a toner particle. The weight-average particle diameter of the toner particle was 6.0 μm.

1.0 part of a hydrophobic silica fine powder (specific surface area by nitrogen adsorption measured by the BET method=140 $m^2/g$) and 3.0 parts of strontium titanate (volume-average particle diameter=1.6 μm) were externally added and mixed with 100 parts of this toner particle followed by screening on a mesh with an aperture of 150 μm to obtain a toner B-1. The glass transition temperature Tg of toner B-1 was 52° C., and no endothermic peak was observed in the measurement temperature range, thus confirming that all of the 9-fluorenone had been compatibilized.

Developer B-1 Production Example

Using a V-mixer (Model V-10, Tokuju Corporation) and conditions of 0.5 $s^{-1}$ and a rotation time of 5 minutes, toner B-1 and the magnetic carrier were mixed at 10.0 parts of toner B-1 per 1.0 part of the carrier to produce a developer B-1. The evaluations were carried out on the obtained developer B-1.

The fixing member contamination, halftone non-uniformity, and low-temperature fixability were evaluated by the same methods as in Example A-1. Developer B-1 was scored with an "A" in all instances.

Example C-1

Toner C-1 Production Example 9.0 parts of tricalcium phosphate was added to 1300.0 parts of deionized water that had been heated to a temperature of 60° C., and stirring was carried out at a stirring rate of 15,000 rpm using a TK Homomixer (Tokushu Kika Kogyo Co., Ltd.) to produce an aqueous medium. In addition, a liquid mixture was prepared by mixing the following materials with stirring at a stirring rate of 100 rpm using a propeller-type stirrer.

| | |
|---|---|
| styrene | 50.0 parts |
| n-butyl acrylate | 30.0 parts |
| binder resin 1 | 5.0 parts |
| Then, | |
| styrene | 20.0 parts |
| C.I. Pigment Blue 15:3 | 7.0 parts |
| aluminum 3,5-di-tert-butylsalicylate compound | 0.5 parts |
| compound represented by general formula [1] (9-fluorenone, melting point: 84° C.) | 3.0 parts |

were added to the aforementioned liquid mixture followed by heating the liquid mixture to a temperature of 65° C. and then stirring at a stirring rate of 10,000 rpm using a TK homomixer (Tokushu Kika Kogyo Co., Ltd.) to effect dissolution and dispersion and prepare a polymerizable monomer composition.

This polymerizable monomer composition was introduced into the aforementioned aqueous medium and 6.0 parts of Perbutyl PV (10-hour half-life temperature=54.6° C. (NOF Corporation)) was added as polymerization initiator and granulation was carried out by stirring at a temperature of 70° C. for 10 minutes at a stirring rate of 12,000 rpm using a TK Homomixer.

Transfer to a propeller-type stirrer was carried out and, while stirring at a stirring rate of 200 rpm, a polymerization reaction was run on the styrene and n-butyl acrylate, which were the polymerizable monomers in the polymerizable monomer composition, for 5 hours at a temperature of 85° C. to produce a toner particle-containing slurry. This slurry was cooled after completion of the polymerization reaction. Hydrochloric acid was added to the cooled slurry to bring the pH to 1.4 and the calcium phosphate salt was dissolved by stirring for 1 hour. This was followed by: washing the slurry with water 10 times the amount of the slurry, filtration, and classification of the dried toner particle using a multi-grade classifier based on the Coanda effect to obtain a toner particle having a negative tribocharging behavior and a weight-average particle diameter (D4) of 6.8 μm.

1.0 part of a hydrophobic silica fine powder (specific surface area by nitrogen adsorption measured by the BET method=140 $m^2/g$) and 3.0 parts of strontium titanate (volume-average particle diameter=1.6 μm) were externally added and mixed with 100 parts of this toner particle followed by screening on a mesh with an aperture of 150 μm to obtain a toner C-1. The glass transition temperature Tg of toner C-1 was 54° C., and no endothermic peak was observed in the measurement temperature range, thus confirming that all of the 9-fluorenone had been compatibilized.

Developer C-1 Production Example

Using a V-mixer (Model V-10, Tokuju Corporation) and conditions of 0.5 $s^{-1}$ and a rotation time of 5 minutes, toner C-1 and the magnetic carrier were mixed at 10.0 parts of toner C-1 per 1.0 parts of the carrier to produce a developer C-1. The fixing member contamination, halftone non-uniformity, and low-temperature fixability were evaluated using the obtained developer C-1 and the same methods as in Example A-1. Developer C-1 was scored with an "A" in all instances.

Example D-1

Toner D-1 Production Example (Preparation of Aqueous Medium)

5.0 parts of $Na_3PO_4$ and 2.0 parts of 10% hydrochloric acid were added to 330 parts of deionized water and this was heated to 60° C. while stirring at 3,000 r/min using a High-Shear Mixer (IKA® Werke GmbH & Co. KG). An aqueous solution of 3.0 parts of $CaCl_2$ dissolved in 20 parts of deionized water was then added and, after 30 minutes, 15 parts of a 48.5 mass % aqueous solution of sodium dodecyldiphenyl ether disulfonate (Eleminol MON-7, Sanyo Chemical Industries, Ltd.) and 30 parts of ethyl acetate were added followed by cooling the liquid temperature to 30° C. to prepare an aqueous medium.

(Masterbatch Production)

| | |
|---|---|
| C.I. Pigment Blue 15:3 | 40 parts |
| binder resin 1 | 60 parts |

were kneaded for 30 minutes at 150° C. using a two-roll mill followed by roll cooling and pulverization with a pulverizer to obtain a masterbatch.

(Synthesis of Intermediate Polyester and Prepolymer)

| | |
|---|---|
| ethylene oxide adduct on bisphenol A (average number of moles of addition: 2.2 mol) | 682 parts |
| propylene oxide adduct on bisphenol A (average number of moles of addition: 2.2 mol) | 81 parts |
| terephthalic acid | 283 parts |
| trimellitic anhydride | 22 parts |
| dibutyltin oxide | 2 parts |

were introduced into a reactor and were reacted for 8 hours at 230° C. at normal pressure. This was followed by reaction for 5 hours at a reduced pressure of 10 to 15 mmHg to synthesize an intermediate polyester.

Then,

| | |
|---|---|
| the intermediate polyester | 410 parts |
| isophorone diisocyanate | 89 parts |
| ethyl acetate | 500 parts |

were introduced and a reaction was run for 5 hours at 100° C. to synthesize a prepolymer.

(Ketimine Synthesis)

170 parts of isophoronediamine and 75 parts of methyl ethyl ketone were introduced into a reactor and were reacted for 5 hours at 50° C. to synthesize the ketimine compound.

(Production of Toner Particle Composition)

150 parts of the masterbatch, 700 parts of binder resin 1, 23 parts of a compound represented by general formula [1] (9-fluorenone, melting point: 84° C.), and 850 parts of ethyl acetate were introduced into a container provided with a stirring rod and a thermometer and mixing was carried out for 10 minutes at a rotation rate of 9,000 rpm using a TK Homomixer (Tokushu Kika Kogyo Co., Ltd.).

Then, while cooling the container and with the rotation rate of the TK Homomixer brought to 1,000 rpm, stirring was performed until the liquid temperature reached 30° C. Once the liquid temperature had reached 30° C., 194 parts of the prepolymer and 6 parts of the ketimine compound were added and a toner particle composition was then obtained by stirring for 30 seconds at a rotation rate of 5,000 rpm.

(Granulation)

The amounts of the materials used were adjusted at the ratio indicated in the following so as to provide a total amount for the granulation slurry of 600 kg. 60 parts of the toner particle composition was introduced into a container into which 140 parts of the aqueous medium had been introduced, and a dispersion of the toner particle composition was obtained by mixing for 10 minutes at 3,000 r/min using a High-Shear Mixer (IKA® Werke GmbH & Co. KG).

(Solvent Removal/Maturation)

After the completion of the granulation step, the dispersion of the toner particle composition was transferred to a container that was being held at 30° C. and stirring at 50 r/min was started and solvent removal was carried out for 10 hours. The jacket internal temperature was then set to 80° C. and the temperature in the container was raised to 55° C. and maturation was carried out for 5 hours at 55° C. to obtain a toner particle.

The obtained toner particle was classified using a multi-grade classifier based on the Coanda effect to obtain a toner particle having a negative tribocharging behavior and a weight-average particle diameter (D4) of 6.8 μm.

1.0 part of a hydrophobic silica fine powder (specific surface area by nitrogen adsorption measured by the BET method=140 $m^2/g$) and 3.0 parts of strontium titanate (volume-average particle diameter=1.6 μm) were externally added and mixed with 100 parts of this toner particle followed by screening on a mesh with an aperture of 150 μm to obtain a toner D-1. The glass transition temperature Tg of toner D-1 was 52° C., and no endothermic peak was observed in the measurement temperature range, thus confirming that all of the 9-fluorenone had been compatibilized.

Developer D-1 Production Example

Using a V-mixer (Model V-10, Tokuju Corporation) and conditions of 0.5 $s^{-1}$ and a rotation time of 5 minutes, toner D-1 and the magnetic carrier were mixed at 10.0 parts of toner D-1 per 1.0 part of the carrier to produce a developer D-1. The fixing member contamination, halftone non-uniformity, and low-temperature fixability were evaluated using the obtained developer D-1 and the same methods as in Example A-1. Developer D-1 was scored with an "A" in all instances.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-193275, filed Sep. 30, 2015, and Japanese Patent Application No. 2016-095152, filed May 11, 2016 which are hereby incorporated by reference herein in their entirety.

What is claimed is:

1. A toner comprising a binder resin, a colorant, and a compound represented by the following general formula [1]:

[1]

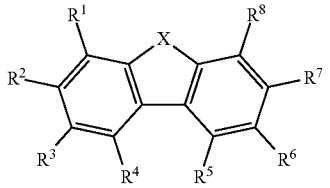

(in the formula, $R^1$ to $R^8$ each independently represent a group selected from the hydrogen atom, fluorine atom, bromine atom, iodine atom, hydroxy group, acetyl group, aldehyde group, $C_1$ to $C_6$ hydrocarbon groups, and amino group; X represents a group selected from the oxygen atom, sulfur atom, carbonyl group, and —$CR^9R^{10}$—; and $R^9$ and $R^{10}$ each independently represent a group selected from the hydrogen atom, bromine atom, $C_1$ to $C_3$ hydroxyalkyl groups, hydroxy group, phenyl group, and $C_1$ to $C_6$ hydrocarbon groups).

2. The toner according to claim 1, wherein the content of the compound represented by general formula [1] is at least 0.1 mass parts and not more than 20 mass parts per 100 mass parts of the binder resin.

3. The toner according to claim 1, wherein the boiling point of the compound represented by general formula [1] is at least 290° C.

4. The toner according to claim 1, wherein the X in general formula [1] is a carbonyl group.

* * * * *